US006089347A

United States Patent [19]

Flugger

[11] Patent Number: 6,089,347

[45] Date of Patent: Jul. 18, 2000

[54] MUFFLER WITH PARTITION ARRAY

[75] Inventor: Ray T. Flugger, Forestville, Calif.

[73] Assignee: Flowmaster, Inc., Nev.

[21] Appl. No.: 09/058,735

[22] Filed: Apr. 13, 1998

Related U.S. Application Data

[63] Continuation of application No. 08/742,651, Nov. 4, 1996, abandoned.

[51] Int. Cl.[7] ..... F01N 1/08

[52] U.S. Cl. ..... 181/264; 181/268; 181/275; 181/281; 181/282

[58] Field of Search ..... 181/264, 265, 181/268, 270, 275, 281, 282, 286

[56] References Cited

U.S. PATENT DOCUMENTS

| | | | |
|---|---|---|---|
| 728,105 | 5/1903 | Hipple et al. | 181/281 |
| 1,084,883 | 1/1914 | Holzwarth | 181/264 |
| 1,294,234 | 2/1919 | Cammen | 181/212 |
| 1,772,589 | 8/1930 | Beamer | 181/265 |
| 2,458,102 | 1/1949 | Schott et al. | 181/264 |
| 3,966,015 | 6/1976 | Bychinsky | 181/56 |
| 4,574,914 | 3/1986 | Flugger | 181/268 |
| 4,809,812 | 3/1989 | Flugger | 181/268 |
| 5,304,749 | 4/1994 | Crandell | 181/264 |
| 5,444,197 | 8/1995 | Flugger | 181/264 |

*Primary Examiner*—Khanh Dang
*Attorney, Agent, or Firm*—Flehr Hohbach Test Albritton & Herbert

[57] ABSTRACT

A muffler (10) having a casing (21), an inlet opening (22) and an outlet opening (26). An initial partition (30) forms an expansion chamber (28). The casing (21) has mounted and formed therein a partition array (34) that includes a divider partition (36), a first intermediate partition (38), and a second intermediate partition (40). Partition array (34) is positioned in a main sound attenuation chamber (46). A collector partition (42) having a collector opening (44) is positioned between array (34) and opening (26). A pre-outlet chamber (48) is formed by collector partition (42) prior to outlet (26).

59 Claims, 13 Drawing Sheets

MUFFLER WITH PARTITION ARRAY

This is a continuation of application Ser. No. 08/742,651 filed Nov. 4, 1996 now abandoned.

TECHNICAL FIELD

The present invention pertains to a muffler for internal combustion engines.

BACKGROUND OF THE INVENTION

One of the biggest problems for manufacturers of mufflers is controlling the sound level in an exhaust system while at the same time keeping the exhaust flow at a sufficiently high level to produce good power output. Part of the problem is that the relationship between engine hard-parts technology and exhaust technology is complex and not fully understood or quantified. A comprehensive analysis of exhaust flow requires a consideration of many factors, such as exhaust air flow, pressure, heat, sound, frequencies, sound energy and exhaust pulses.

To understand better what happens in an exhaust system, consider what happens to one exhaust pulse from the cylinder where it begins, until it exits into the atmosphere. As an exhaust stroke is being completed, the exhaust valve opens and an exhaust pulse exits into the exhaust system. This pulse, for example, can be like a tennis ball traveling down the exhaust pipe. At the moment the pulse exits the cylinder, it can be traveling at almost 1,000 feet per second with sound energy accompanying it. Directly behind the pulse, a low pressure area is created.

The further away from the cylinder the pulse travels, the more heat and speed it loses. Anything that creates back pressure will slow its progress even more. As the pulse reaches the end of the exhaust pipe and exits into the atmosphere, the low pressure area behind the pulse is suddenly replaced by atmospheric pressure. Timing the pulses to exit at regular intervals is important for good performance as it reduces back pressure by keeping the low pressure area in the pipe helping to pull the next pulse through the exhaust system.

Controlling exhaust pulse timing while attempting to control sound levels or sound energy within acceptable limits can be difficult, and doing so without an accompanying loss of power and air flow through the engine is one of the more difficult problems faced by muffler manufacturers. My previous U.S. Pat. No. 4,574,914, which is the subject of Reexamination Certificate No. 1599, discloses an earlier attempt of mine to develop a muffler that is effective in attenuating sound and which can even reduce back pressure when used on certain high performance engines. The muffler of my '914 patent is based, in part, on the principle of first dividing incoming exhaust gases and then reconverging them back together prior to releasing the exhaust gases from the muffler.

My more recent U.S. Pat. No. 5,444,197 improves upon the concept and design of my earlier '914 patent. My '197 patent incorporates an intermediate reflector partition between the divided exhaust gases and the converging exhaust gases. This intermediate partition directs portions of the sound components in the exhaust gases away from the muffler outlet opening.

While the mufflers of my '914 patent and my '197 patent are highly effective and in wide-spread use in both racing and street vehicles, it is always highly desirable to further reduce muffler back pressure and at the same time further attenuate sound components entrained in exhaust gases. In addition, for certain applications, my prior muffler designs are too quite. A certain amount of low RPM engine "rumble" on the outside of the vehicle without resonating in the interior of the vehicle can be desirable. For this reason, it is desirable to be able to tune the sound frequencies to a particularly pleasing frequency profile.

It is an object of the present invention to provide a method and apparatus for tuning the sound frequency profile of an engine exhaust system to desirable levels.

It is another object of the present invention to provide a method and apparatus for decreasing the overall sound levels produced by an engine exhaust system.

It is another object of the present invention to provide a method and apparatus for controlling low pressure regions in an engine exhaust system.

It is another object of the present invention to achieve one or more of the foregoing objects with a muffler that is inexpensive to manufacture and install, yet which is durable enough in construction to withstand the harsh environment of an engine exhaust system.

These and other objects of the invention will become apparent from the following Disclosure of the Invention and Best Mode section and the accompanying drawings.

DISCLOSURE OF THE INVENTION

Briefly described, the present invention includes a muffler that has a casing with an inlet opening an outlet opening, a first divider partition secured in the casing for dividing substantially all incoming exhaust gases around the first divider partition, and a second collector partition secured in the casing downstream of the first divider partition. The second collector partition forms in part a collector opening wherein exhaust gases are directed toward each other for flow through the collector opening. The improvement of the present invention comprises the provision of a first intermediate partition secured in the casing between the divider partition and the collector partition. The first intermediate partition is positioned to permit flow of the divided exhaust gases past outward ends of the first intermediate partition, which are spaced downstream of the outward ends of the divider partition. The spaces defined between the outward end portions of the divider partition and the outward end portions of the first intermediate partition are oriented with respect to the exhaust gas flow path so as to create a low pressure region in these spaces as exhaust gases flow past the outward ends of the partitions.

The orientation of the spaces defined between the outward end portions of the divider and intermediate partitions with respect to the flow path of the exhaust gases creates a venturi effect wherein the low pressure region is formed between the partitions. Preferably, the angle of orientation between these spaces and the exhaust gas flow path is no greater than approximately one hundred degrees.

According to an aspect of the invention, the entire space defined between the divider and intermediate partitions is generally concave in shape and faces away from the direction of the incoming exhaust gases. In this manner, the incoming exhaust gases flow around the divider partition and past the space between the divider partition and the intermediate partition. Preferably, the space between the divider and intermediate partitions is defined by divergently tapered partition walls. This creates generally V-shaped partitions with parallel partition walls that define a substantially V-shaped space.

According to another aspect of the invention, in some applications it may be preferable for the intermediate partition to be larger in size than the divider partition, in order to control certain frequencies. For example, for racing engines and some street cars, a larger intermediate partition can provide an acceptable low RPM sound level. However, it is within the scope of the invention to provide substantially equal size divider and intermediate partitions, and to provide a divider partition that is larger in size than the intermediate partition.

According to another aspect of the invention, a second intermediate partition is provided along side the first intermediate partition. The second intermediate partition, like the first intermediate partition, is formed to permit flow of exhaust gases past outward ends of the second intermediate partition. In addition, the spaces defined between the outward ends of the second intermediate partition and the first intermediate partition are oriented with respect to the exhaust gas flow path so as to create a low pressure region in the spaces between the first and second intermediate partitions. Furthermore, it is preferable that the first and second intermediate partitions have generally the same shape, although their relative sizes may vary.

According to another aspect of the invention, a reflector partition is provided between the intermediate partitions and the collector partition. The reflector partition is like that disclosed in my prior '197 patent. The reflector partition has a surface cupped in a direction facing away from the collector partition. The reflector partition, like the divider partition and the intermediate partitions, is formed and positioned to permit the exhaust gases to flow uninterrupted past the outward ends of the reflector partition.

According to another aspect of the invention, the divider partition and the first and second intermediate partitions are arranged so that sound is attenuated in the spaces between these partitions as exhaust gases are directed past the outward ends of the partitions. The outward portions of the spaces defined between the divider partition and the first and second intermediate partitions are oriented at an angle with respect to the direction of exhaust gas flow past the outward ends of the partitions, which angle is sufficient to allow sound vibrations to enter the spaces between the partitions, yet is not so great as to interrupt the exhaust gas flow and divert a substantial amount of exhaust gases from the main exhaust gas flow path.

The lengths of the spaces defined between the divider partition and the first intermediate partition and between the first and second intermediate partitions can be selectively varied. The different length spaces are believed to have a significant influence on the sound frequencies emanating from the muffler. Specifically, the different length spaces are designed to tune out, or in some cases tune in, certain frequency sound components.

The method of the present invention of attenuating sound in a muffler formed by a casing with an inlet and outlet opening, a partition array including a divider partition and at least one, but preferably two, intermediate partitions spaced downstream from the divider partition, and a collector partition, comprises the steps of introducing exhaust gases through the muffler inlet opening, passing the exhaust gases around the divider partition to direct the incoming exhaust gases at least partially laterally around outward ends of the divider partition. The method of the present invention further includes the step of passing the exhaust gases past the outward ends of the first and second intermediate partitions in a manner whereby sound is attenuated in the spaces between the divider partition and the first and second intermediate partitions as exhaust gases are directed past the partitions. The method also includes the step of passing the exhaust gases through an opening in the collector partition and out through the muffler outlet opening.

BRIEF DESCRIPTION OF THE DRAWINGS

In the drawings, like reference numerals refer to like parts throughout the several views wherein.

BEST MODE FOR CARRYING OUT THE INVENTION

Figure 1:
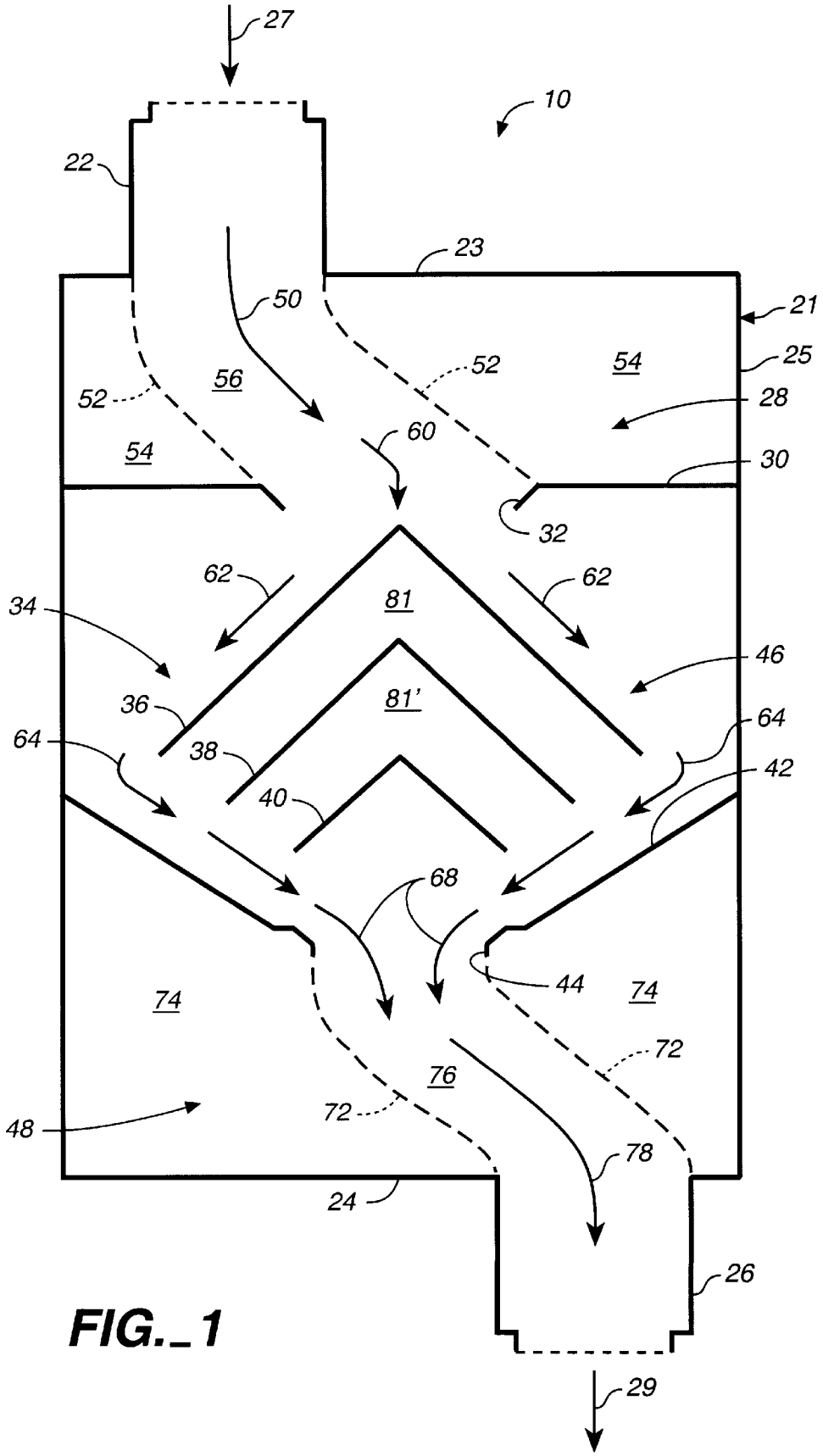
FIG. 1 is a schematic view showing the interior design of the muffler of the present invention.

Referring to FIG. 1, the present invention comprises a muffler 10 that is formed by a casing 21, an inlet pipe 22 and an outlet pipe 26. Casing 21 includes sidewalls 25 and end walls 23 and 24. Inlet pipe 22 and outlet pipe 26 extend through end walls 23 and 24. In order to facilitate fabrication of a high strength, durable muffler, casing sidewalls 25 are preferably formed from longitudinally extending casing halves that are joined together along longitudinally extending upper and lower seams, preferably by welding. The inlet and outlet pipes are welded to the end walls and the end walls are then welded or otherwise secured to the casing halves. A more detailed discussion of the construction of casing 21 can be found in my prior '914 patent.

Exhaust gases enter inlet pipe 22, as shown by arrow 27, and exit through outlet pipe 26, as shown by arrow 29. As used herein, the term "downstream" refers to a direction within casing 21 generally away from inlet pipe 22 and toward outlet pipe 26.

Within casing 21, an initial expansion chamber 28 is formed by an initial partition 30 that includes a central opening 32. The function and operation of expansion chamber 28 is discussed later. An array of partition walls 34 are formed and positioned within casing 21 downstream of opening 32. Partition array 34 includes a divider partition 36, a first intermediate partition 38, and a second intermediate partition 40. Downstream of partition array 34 is formed a collector partition 42 having a central collector opening 44. The initial partition 30, collector partition 42, and casing 21 define a main sound attenuation chamber 46.

Collector partition 42, casing 21, and casing end wall 24 define a pre-outlet chamber 48.

Partitions 30, 36, 38, 40 and 42, all extend the full height dimension of muffler 10, which is the dimension into and out of the figure. Preferably, such height dimension is approximately 4–5 inches. During the assembly process, these partitions, each of which includes flanges (shown and discussed in later figures), can be inserted into the assembled casing halves of casing 21 and welding in place. Similarly, end walls 23 and 24 can be provided with flanges for welding the end walls to the sidewalls of casing 21. Also, end walls 23, 24 and inlet pipe 22 and outlet pipe 26 can be provided with cooperating flanges for welding the inlet and outlet pipe to the casing.

Preferably, the muffler components discussed herein are made of 16 gauge aluminized steel, which has high strength and corrosion resistant characteristics suitable for engine exhaust systems, and yet which is relatively light in weight. Other comparable materials known in the art can be used for the present invention.

Incoming exhaust flow gases, represented by arrow 27, move through inlet pipe 22 and into expansion chamber 28, as shown by arrow 50. Within expansion chamber 28, boundary layers 52 form between relatively stagnate high pressure regions 54 and a high velocity, low pressure region 56. Most of the exhaust gases flow through low pressure region 56 and out through opening 32.

It should be noted that the relative position of inlet pipe 22 along the width of casing end wall 23 is selectively variable and generally depends upon installation criteria dictated by the chassis and tail pipe design of the vehicle on which the muffler is installed. It should also be noted that expansion chamber 28 can be eliminated, as is done with the muffler disclosed in my prior '197 patent. The provision of expansion chamber 28 makes the design of muffler 10 compatible with any location of inlet pipe 22 along the width of the muffler. For example, inlet pipe 22 could be centrally located and in alignment with opening 32, or inlet pipe 22 could be located to the other side of casing wall 23. In either case, boundary layers, like boundary layers 52, will form in the expansion chamber between the edges of the inlet pipe and the edges of opening 32. While deflector partitions could be provided between inlet pipe 22 and opening 32 for directly routing exhaust gases through expansion chamber 28, it has been found that designing expansion chamber 28 so as to allow for the creation of boundary layers between the inlet pipe and the initial partition opening creates less back pressure than providing deflector partitions.

Arrow 60 represents the incoming exhaust gases into sound attenuation chamber 46. Divider partition 36 is positioned within chamber 46 to receive incoming exhaust gases 60 and divide the flow of these gases toward sidewalls 25 of the casing. The divided exhaust gas flows are represented by arrows 62. The divided exhaust gases 62 move around the outward ends of divider partition 36 and flow past first and second intermediate partitions 38, 40, as shown by arrows 64. Collector partition 42 causes the divided exhaust gases 64 to reconverge and flow out collector opening 44, as represented by arrows 68. The reunited exhaust gases flow through pre-outlet chamber 48, shown by arrow 78, prior to exiting through outlet pipe 26.

Within pre-outlet chamber 48, boundary layers 72, similar to boundary layers 52 of expansion chamber 28, form to define high pressure regions 74 and low pressure region 76. Most of the exhaust gases flow through region 76. As used herein, the term "main flow path" and "exhaust gas flow path" refer to the path that the majority of exhaust gases take as they move through muffler 10, and which path is collectively defined by arrows 50, 60, 62, 64, 68 and 78. Further, the illustration of boundary layers 52, 72 is not meant to indicate that there are no additional boundary layers formed within chamber 46. Many such boundary layers probably do form in the main chamber, but since the gas flow phenomena within the main chamber is not necessarily fully understood, no attempt has been made to illustrate the locations of these boundary layers.

Figure 2:
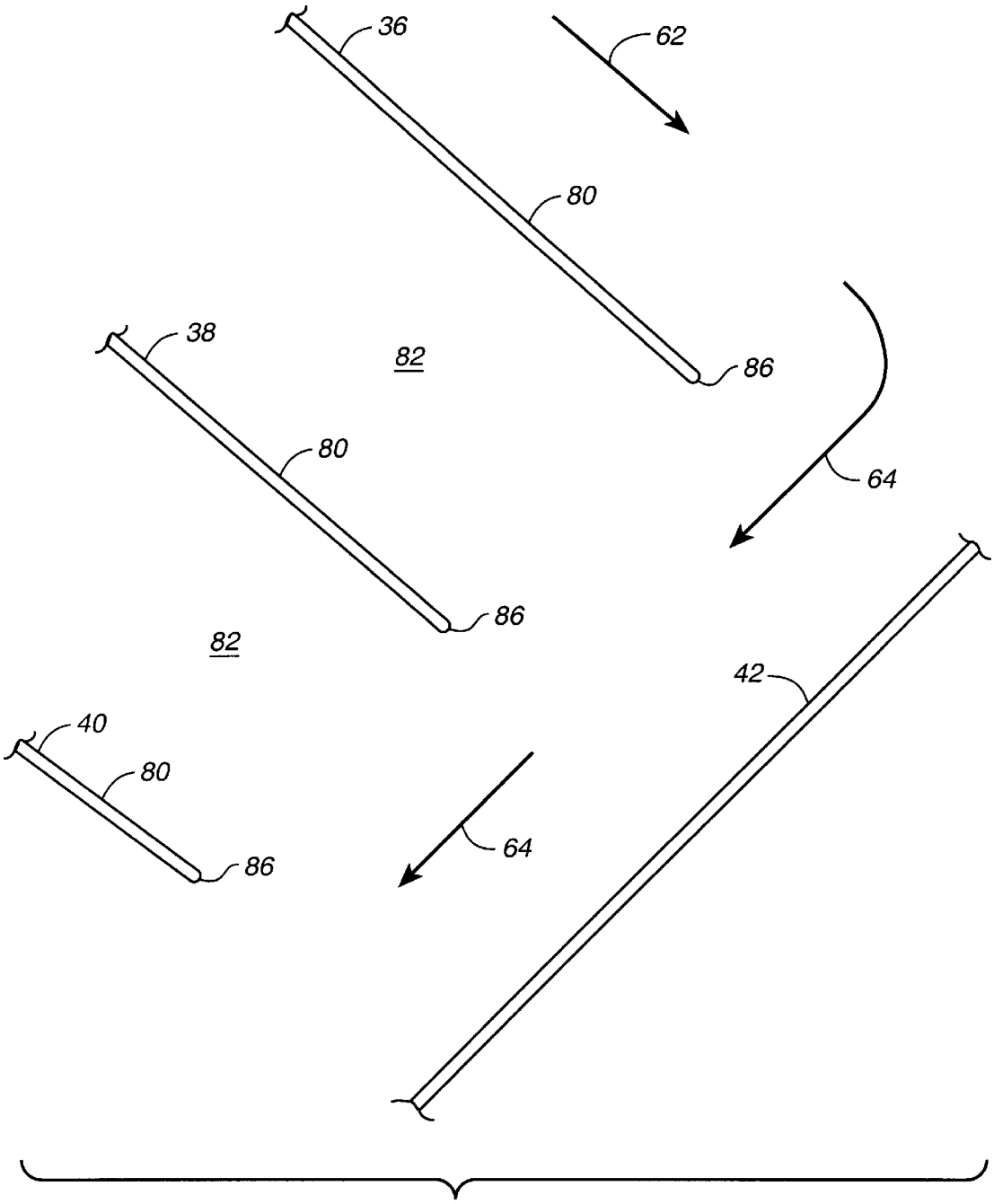
FIG. 2 is an enlarged schematic view of the outward ends of the partitions shown in the muffler of FIG. 1.

FIG. 2 is an enlarged schematic view of the outward ends of partitions 36, 38, 40 and adjacent collector partition wall 42. The outward end portions 80 of partitions 36, 38, 40 define between them spaces 82. Spaces 82 are oriented with respect to the flow path of exhaust gases 64 so as to create a low pressure region within spaces 82 as exhaust gases 64 flow past outward ends 86. This creates something of a venturi effect wherein exhaust gases 64 draw gases from within spaces 82, creating low pressure regions between the partition walls. The orientation of spaces 82 with respect to flow path 64 is such that sound vibrations enter spaces 82 and reflect off of the partition walls, so that sound vibrations are attenuated between the partitions prior to exiting the muffler.

Preferably, the angle of orientation between spaces 82 and the flow path of exhaust gases 64 is not so great as to divert a substantial amount of exhaust gases 64 into spaces 82. In other words, the flow of exhaust gases 64 should not be substantially interrupted by the ends 86 of the partition walls. In FIG. 2, spaces 82 are generally aligned with partition walls 80 and the angle between the alignment of spaces 82 and the flow path of exhaust gases 64 is approximately ninety degrees. It is preferable that this angle of orientation be no greater than approximately one hundred degrees. If the angle between the alignment of spaces 82 and the flow path of exhaust gases 64 is designed too great, a substantial amount of exhaust gases may flow into spaces 82, which would interrupt the exhaust gas flow and disturb the low pressure regions between the partition walls. This could potentially increase back pressure in the exhaust system. Also, diversion of the exhaust gases into spaces 82 would adversely effect the sound attenuation advantages achieved by creating the low pressure regions within spaces 82.

Referring to FIGS. 1 and 2, partition array 34 is shown in the form of a descending array wherein first intermediate partition 38 is smaller than divider partition 36, and second intermediate partition 40 is smaller still. Spaces 81, 81' are defined as the spaces between partitions 36, 38, 40. The outward end portions of spaces 81, 81' are referred to as spaces 82 in FIG. 2. Because partition 36, 38, 40 are divergently tapered, they each form a V-shape, which makes spaces 81, 81' generally V-shaped. However, partitions 36, 38, 40 could have other shapes, such as C-shapes or perhaps the partitions could be straight across partitions. However, it is preferable that the partitions be generally cup-shaped or concave. In addition, these partitions can be approximated by planar surfaces, or can be formed as arcuate or spherical surfaces.

What is believed to be important to achieving sound reduction and back pressure reduction is the length of spaces 81, 81' and the relationship between the outer portions 82 of spaces 81, 81' and the main flow path of the exhaust gases past spaces 82. Generally, however, it is preferable that spaces 81, 81' be concave in shape and face away from incoming exhaust gases 60.

Figure 3:
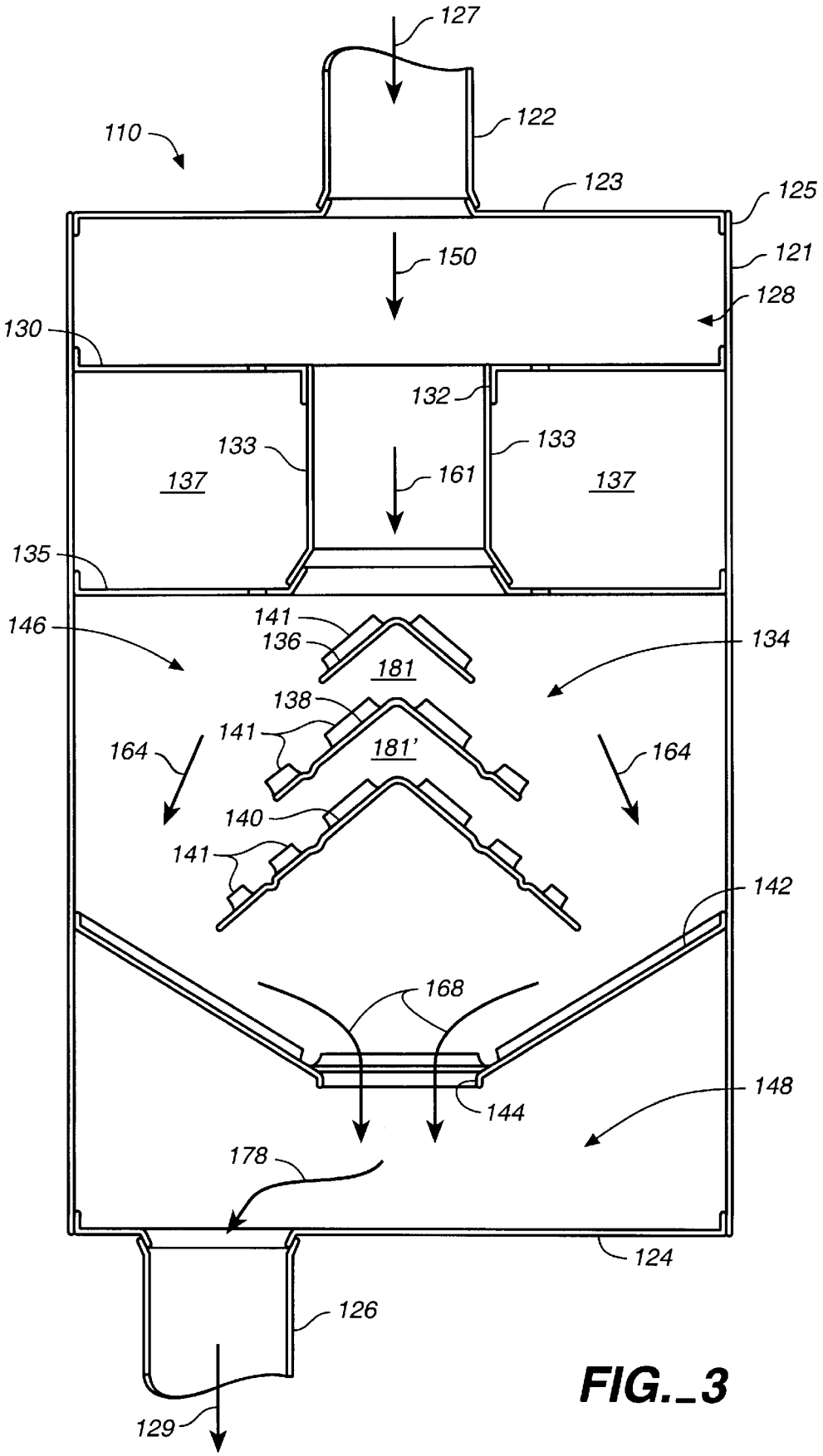
FIG. 3 is a longitudinal cut-away view of a first embodiment of the muffler of the present invention, showing an ascending partition array.

Referring to FIG. 3, a second embodiment of a muffler 110 of the present invention is shown to include a casing 121 having sidewalls 125 and casing end walls 123, 124, inlet pipe 122 and outlet pipe 126. Muffler 110 includes a partition 130 that has a central opening 132 and which defines an expansion chamber 128. A flow tube 133 and an additional partition 135 define optional helmholtz chambers 137. When used, helmholtz chambers 137 would be provided with additional flow tubes (not shown) extending between chambers 137 and expansion chamber 128. Helmholtz chambers are utilized to eliminate interior resonances. While it may be desirable to use a helmholtz chamber in combination with the present invention, the improved design of muffler 110 has proven to be so successful in eliminating and improving sound quality that the provision of a helmholtz chamber is not necessary for a vast majority of applications. Thus, the helmholtz chambers 137 of muffler 110 are non-functional and are included primarily for comparison testing of the muffler with a comparable helmholtz chamber-equipped muffler of the prior art. Helmholtz chambers 137 can be eliminated by eliminating flow tube 133 and partition 135 and by reducing the overall length of muffler 110, similar to the muffler schematically represented in FIG. 1.

The length and width of muffler 110 is not believed to be critical to the present invention, although the relative positions of the partitions and the spacing therebetween within the casing are believed to have a significant affect on sound quality and back pressure reduction. Muffler 110, as well as the mufflers of FIGS. 5–7, all are designed to have a length of approximately 17 inches. Muffler 10 of FIG. 1 has a length of approximately 13 inches, due to its elimination of the helmholtz chambers. The mufflers of FIGS. 3–7 are approximately 10 inches in width, while the muffler of FIG. 1 is approximately 9½ inches. As previously stated, the mufflers all have a height dimension of approximately 4–5 inches. These height, width and length dimension are providing as examples of muffer sizes that have proven to work well for many types of racing and street engine cars.

In FIG. 3, entering exhaust gases, represented by arrow 127, flow through inlet pipe 122, through expansion chamber 128, as shown by arrow 150, through flow tube 133, as shown by arrow 161, and into a main sound attenuation chamber 146. A partition array 134 is formed and positioned within chamber 146 to receive and divide the incoming exhaust gases 161. Partition array 134 includes a divider partition 136, a first intermediate partition 138, and a second intermediate partition 140. Partitions 136, 138, 140 extend the full height of casing 21 and are shown to include flanges 141 for securing the partition walls to casing sidewalls 125.

Partition array 134 is referred to as an ascending array, because first intermediate partition 138 is larger in size than divider partition 136, and second intermediate partition 140 is larger than first intermediate partition 138. Spaces 181, 181' are defined between partitions 136, 138, 140 and are generally concave in shape and face away from incoming exhaust gases 161. Incoming exhaust gases 161 are divided by divider partition 136, and then flow past the outer ends of partitions 136, 138, 140. These divided exhaust gas flows are represented by arrows 164.

Muffler 110 further includes a collector partition 142 having a central collector opening 144. Collector partition 142 is positioned downstream of partition array 134. Exhaust gases 164 are directed inwardly by collector partition 142 where the exhaust gases reconverge, as shown by arrows 168, and flow through collector opening 144. Exhaust gases 168 then flow through a pre-outlet chamber 170 and through outlet pipe 126, as represented by arrows 178 and 129. Within expansion chamber 128 and pre-outlet chamber 170, boundary layers form between high and low pressure regions, in a manner similar to that discussed with reference to muffler 10 schematically shown in FIG. 1. However, the boundary layers formed in the expansion chamber and pre-outlet chamber of the muffler 110 will have different shapes than the boundary layers shown in muffler 10, due to the different positions of inlet pipe 122 and outlet pipe 126.

Figure 4:
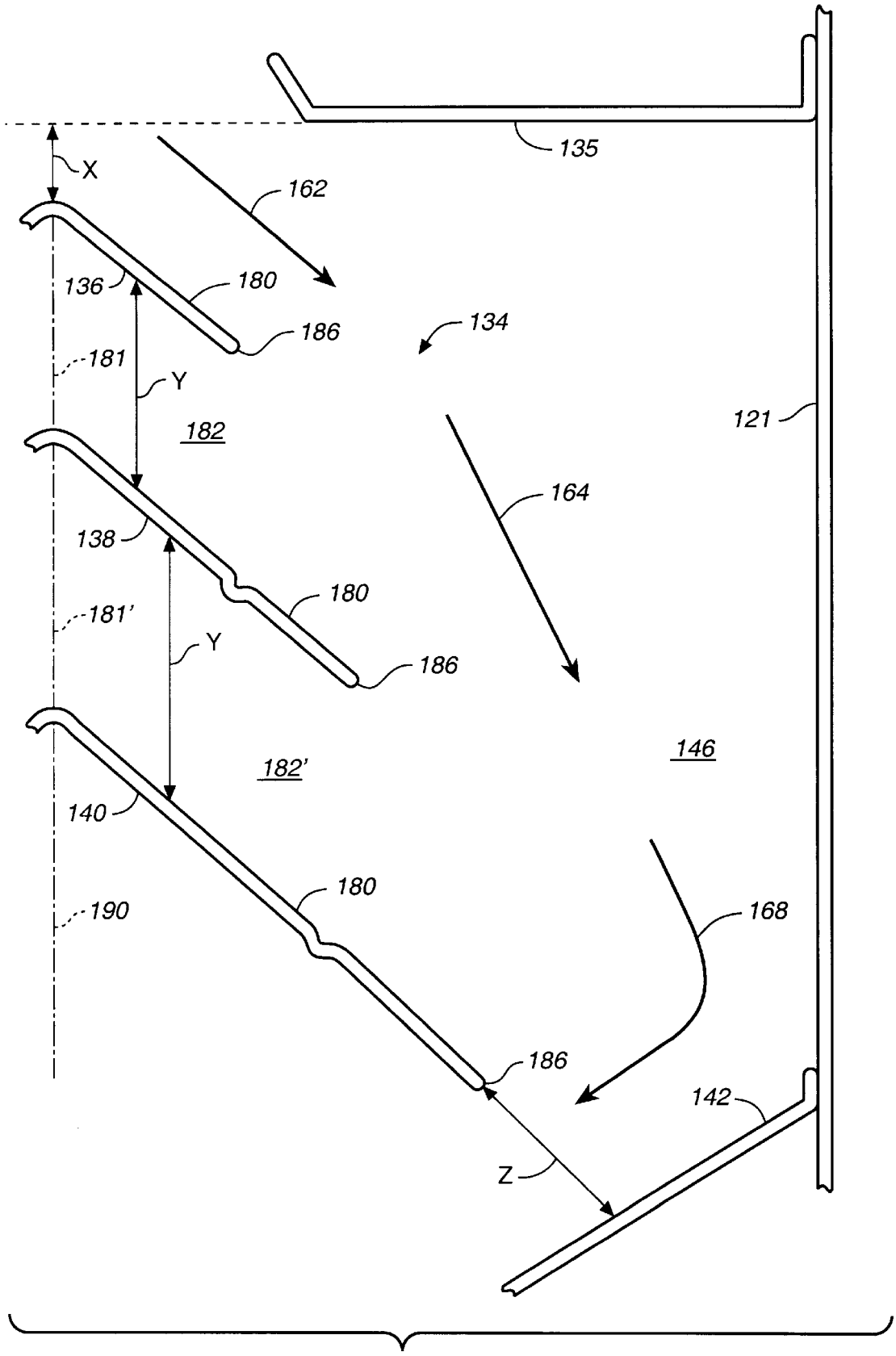
FIG. 4 is an enlarged view of the ends of the partition walls of the muffler of FIG. 3.

FIG. 4 is an enlarged view of one side of main sound attenuation chamber 146. The outward ends 186 of divider partition 136 and intermediate partitions 138, 140 define one side of the main flow path of the exhaust gases, represented primarily in FIG. 4 by arrow 164. Arrow 162 represents one-half of the divided incoming exhaust gases, and arrow 168 represents the exhaust gases moving around the outward end 186 of second intermediate partition 140 between end 186 and collector partition 142. For clarity, the flanges that attach the partitions to casing 121 are not shown.

Partitions 136, 138, 140 have outward end portions 180 that define between them spaces 182, 182'. Spaces 182, 182' form the outer portions of spaces 181, 181'. The walls of partitions 136, 138, 140 are generally parallel with each other, which means that spaces 182, 182' are generally aligned with each other and are similarly aligned with respect to the flow path of exhaust gases 164. However, perfect alignment of spaces 182, 182' may not be necessary and the present invention is not meant to be limited to a muffler having parallel or perfectly aligned partition walls. What is considered part of the invention is the relationship between spaces 182, 182' and the flow path of exhaust gases 164. As exhaust gases 164 flow past outward ends 186 of the partition walls, low pressure develops in the regions of spaces 182, 182'. Also, sound vibrations enter into spaces 182, 182' and are attenuated therein as they reverberate between the partition walls.

Referring to FIGS. 3 and 4, reference numerals 181, 181' refer generally to the entire spaces defined between partition walls 136, 138, 140. Reference numerals 182, 182' are meant to refer only to the outward portions of spaces 181, 181', which outward portions are in part defined by outward portions 180 of the partition walls. As can be seen from FIGS. 3 and 4, the length of space 181 between divider partition 136 and first intermediate partition 138 is shorter in its V-shaped configuration than the length of V-shaped space 181'. It is believed that these different length spaces defined between the partitions walls have a significant effect on dampening and/or tuning particular sound frequencies.

Varying the spacing between partitions 136, 138, 140, which spacing is represented by reference letter Y in FIG. 4, may also have an affect on dampening particular sound frequencies, as may varying the angle of the partition walls with respect to the exhaust gas flow path. However, it is believed that varying the length of spaces 181, 181' has a greater effect on controlling sound quality than does varying the relative spacing or angle of the partition walls. In the diverging partition array of the muffler of FIGS. 1 and 2, the spaces between the partition walls also vary in length. Like muffler 110 of FIGS. 3 and 4, the different length spaces of the muffler of FIGS. 1 and 2 are believed to have a significant effect on tuning sound frequencies. As discussed in more detail later, the muffler of FIGS. 3 and 4 has many of the same sound reduction and tuning benefits as the muffler of FIGS. 1 and 2, but seems to do a better job of reducing resonate interior frequencies.

In FIG. 4, reference letter X represents the distance between partition 135 and the apex of divider partition 136.

In muffler 110, this distance is approximately ½ inch. Reference letter Z represents the distance between outward end 186 of second divider partition 140 and collector partition 142. This distance is approximately 1¼ inches. Distance Y is approximately 1 9/16 inches. A centerline 190 is defined by the apexes of the partitions 136, 138, 140. The distance between centerline 190 and outward end 186 of divider partition 136 is approximately 1⅛ inches. The distance between centerline 190 and outward end 186 of first intermediate partition 138 is approximately 1 15/16 inches. The distance between centerline 190 and outward end 186 of second divider partition 140 is approximately 2 11/16 inches. Again, these distances are provided for exemplary purposes.

Figure 5:
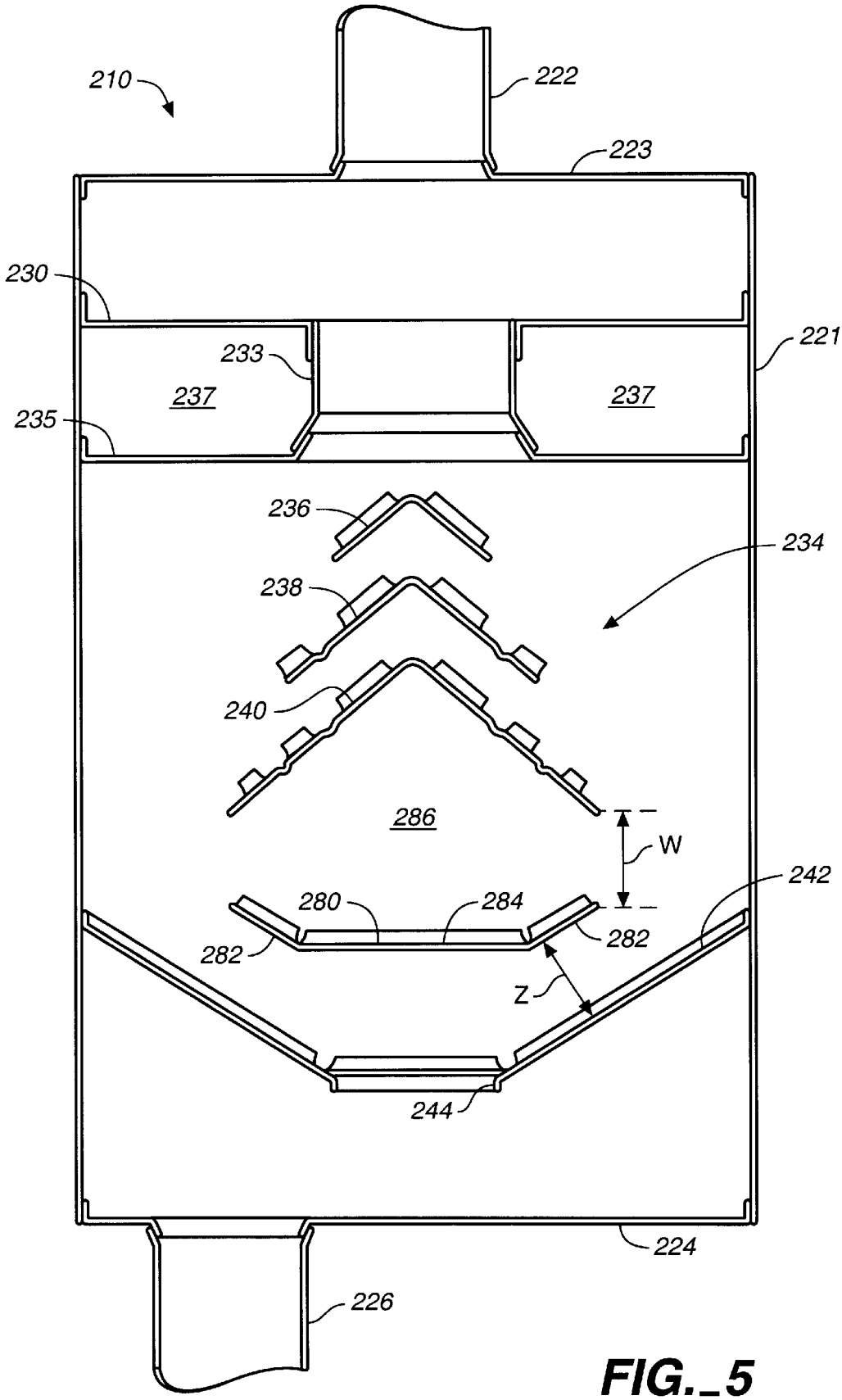
FIG. 5 is an alternate embodiment of the muffler shown in FIG. 3, wherein a reflector partition has been added between the partition array and the collector partition.

Referring to FIG. 5, shown is a muffler 210 that is a modified or alternate version of the muffler shown in FIGS. 3 and 4. Muffler 210, like the muffler of FIG. 3, includes an inlet pipe 222, an outlet pipe 226, a casing 221, end walls 223, 224, a partition array 234 comprising a divider partition 236, a first intermediate partition 238, and a second intermediate partition 240. Muffler 210 also includes a collector partition 242 having a collector opening 244, and partitions 230, 235 and a shortened flow tube 233, which define non-functional helmholtz chambers 237. Flow tube 233 is shortened, as compared to the flow tube of the muffler of FIG. 3, so that the overall length of muffler 210 is the same as the length of the muffler of FIG. 3. Having different muffler designs of the same length simplifies installation procedures and allows for more uniform comparison testing between the mufflers.

The improvement in the muffler 210 over the muffler of FIG. 3 resides in the provision of a reflector partition 280. Reflector partition 280 includes side wing portions 282, which give reflector partition 280 what may be considered a "cupped" shaped or "concave" surface 284. Cupped shaped surface 284 faces away from collector opening 244. Reference letter W represents the distance between the outward end s of second intermediate partition 240 and reflector partition 280, and is approximately 2 inches. Reference letter Z represents the distance between the side wings 282 of reflector partition 280 and collector partition 242, and is approximately 1¼ inches.

As discussed in my prior '197 patent, sound vibrations move into the space 286 defined generally between second intermediate partition 240 and reflector partition 280, wherein they are reflected off of surface 284 and in a direction away from collector opening 244. Further details on the design criteria and benefits of reflector partition 280 are discussed in my prior '197 patent, which discussion is applicable to the present invention as well.

Figure 6:
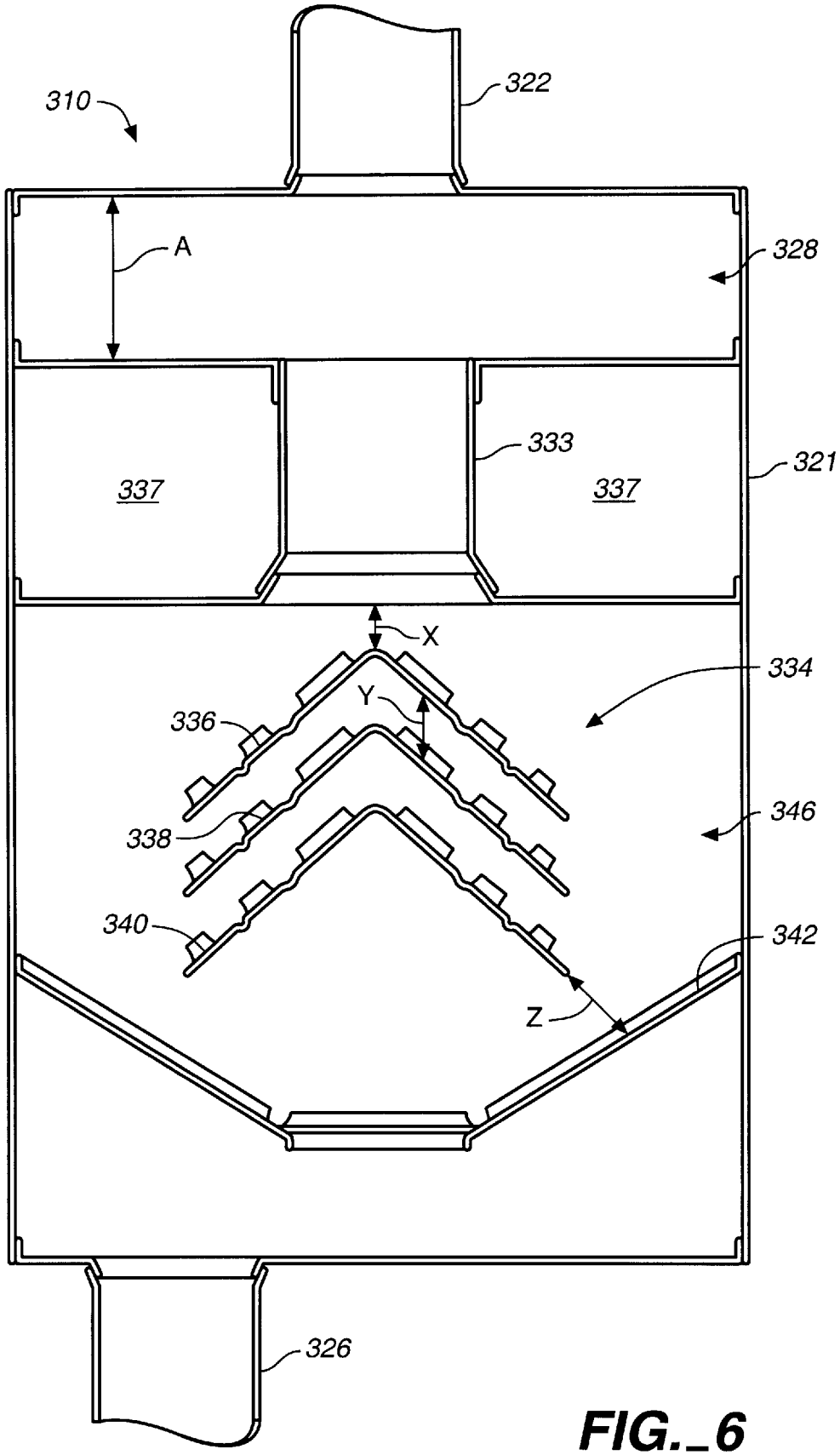
FIG. 6 is a longitudinal cut-away view of a second embodiment of the muffler of the present invention, showing a partition array with approximately equal size partitions.

FIG. 6 shows a third embodiment of a muffler 310 that is nearly identical to the muffler 110 of FIG. 3, with the following differences. Muffler 310 includes a uniform partition array 334 having a divider partition 336, a first intermediate partition 338, and a second intermediate partition 340. Each partition 336, 338, 340 is identical in size and shape and is generally aligned with the other partitions. In addition, muffler 310 includes a flow tube 333 that is longer than the flow tube of the muffler of FIG. 3. Expansion chamber 328 is approximately four inches in length, rather than the three inch length of expansion chamber 128 of muffler 110. As shown by reference letter A, expansion chamber 328 is approximately 3 inches in length, and as shown by reference letter B, non-functional helmholtz chambers 337 are approximately 5 inches in length. Other than these differences, muffler 310 is essentially the same as muffler 110. The distances represented by reference letters X, Y, Z for muffler 310 are the same as previously discussed.

It should be noted that the reflector partition 282 of muffler 210 of FIG. 5 can also be incorporated into muffler 310 by positioning the reflector partition between second intermediate partition 340 and collector partition 342 and by shortening flow tube 333.

Figure 7:
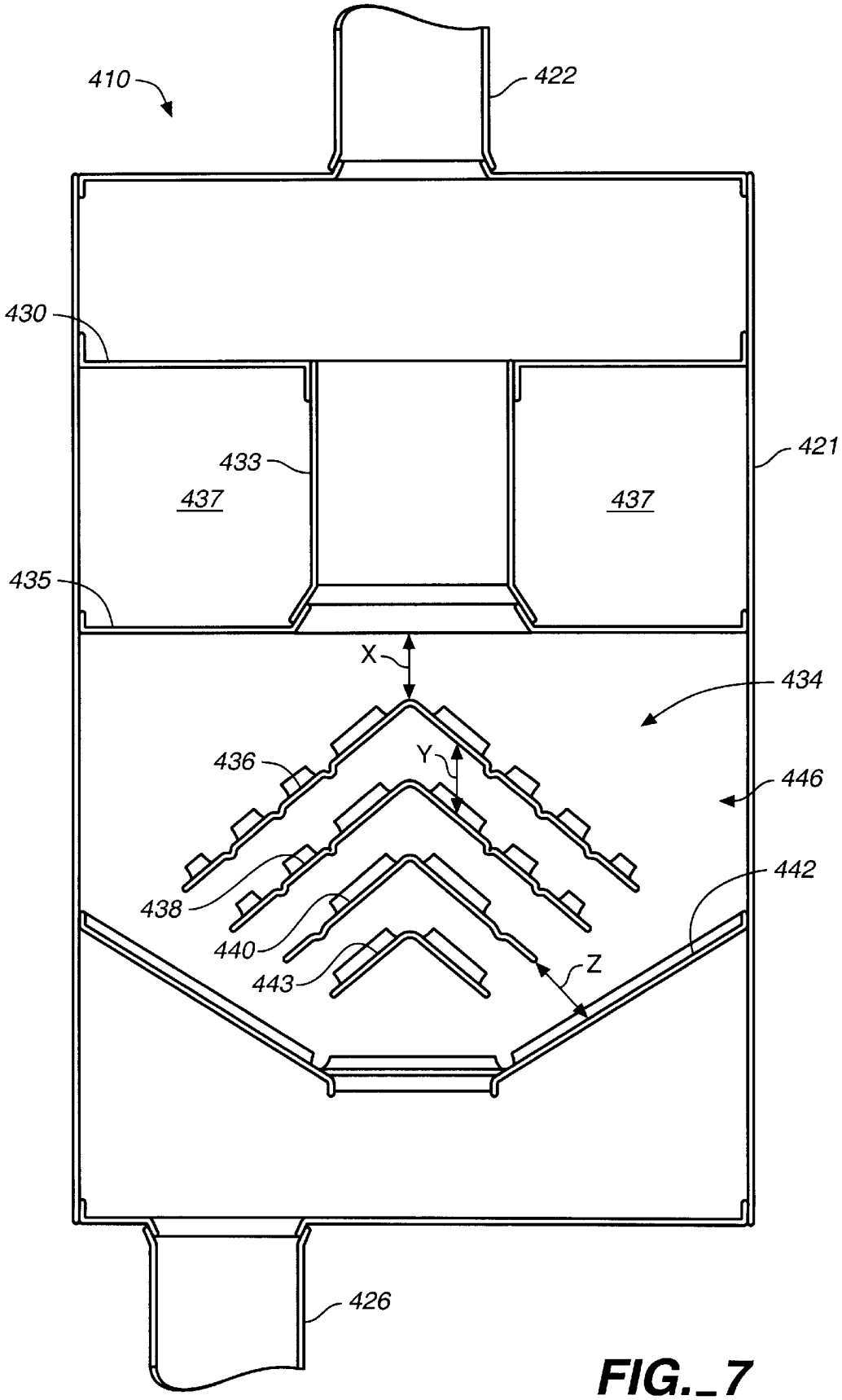
FIG. 7 is a third embodiment of the muffler of the present invention, showing a descending partition array having four partitions.

FIG. 7 is another embodiment of a muffler 410 that is similar to the muffler schematically shown in FIG. 1. Muffler 410 includes partitions 430, 435 and a flow tube 433, which define non-functional helmholtz chambers 437. Muffler 410 also includes a partition array 434 that is formed as a descending array like that of the muffler of FIG. 1, except that a third intermediate partition 443 has been added in addition to partition 436, 438, 440.

It should be noted that in muffler 410, as well as in the muffler of FIGS. 1 and 2, the distances between the outward ends of the divider and intermediate partitions and the collector partition, as shown by reference letter Z, are approximately equal. This creates a flow path for the exhaust gases through chamber 446 that has a substantially uniform cross-sectional area. As a result, the main flow of the exhaust gases is not interrupted, and the spaces between the partition walls can function to control sound frequencies.

The muffler of FIG. 1, as compared to a muffler without intermediate partitions 38, 40, significantly reduces higher frequencies and eliminates many driving range resonate frequencies, which tend to occur at approximately 1700–2500 RPM. Above 3500 RPM, total sound volume is reduced by approximately 3–6 dbA. Airflow is at least the same, if not better, with the design of muffler 10. The muffler 110 of FIGS. 3–4, achieves much the same sound reduction and sound quality benefits as muffler 10, but achieves even better reduction of driving range interior frequencies.

The muffler 210 of FIG. 5 is quiet at a broad band of desirable frequencies. It is believed that total sound reduction may be as high as 10 dbA across a broad sound spectrum. With muffler 210, it should not be necessary to utilize a helmholtz chamber for any applications. Muffler 310 of FIG. 6 works well at reducing sound levels, but does not seem to have as broad of a band in resonate frequency reduction. Muffler 410 did not perform as well as muffler 10. Muffler 410 started to lose some of the cleanness achieved with muffler 10. For this reason, it is believed that the provision of three partitions for the partition array is the desirable number for achieving optimum sound performance. The provision of two partitions for the partition array is believed to work satisfactorily and the provision of four partitions, as shown in FIG. 7, also work satisfactorily , but the mufflers tested with three partitions in their partition array subjectively sounded the best.

While not shown in the drawings, the partition walls of the various partitions shown in the several views can be provided with one of more small vents or openings to allow for burning of residual fuel trapped within the casing of the muffler. Any such type openings should be small enough to prevent as little sound vibrations as possible from passing through the openings.

Figure 8:
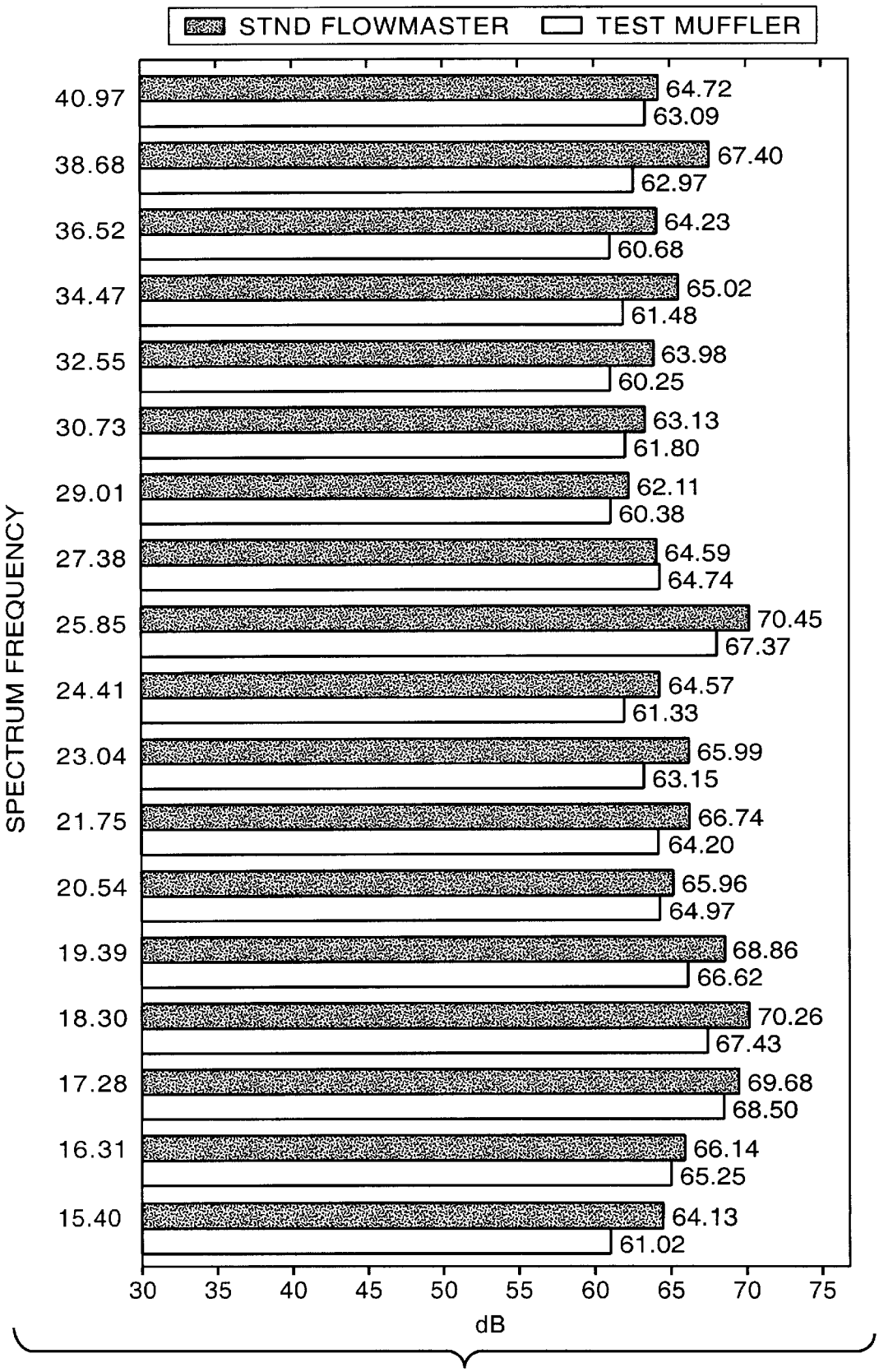
FIGS. 8–11 are each graphic representations of muffler loudness in decibels (dB) as a function of sound frequency in hertz at 1500 and 3000 RPM engine speeds for the muffler of FIG. 7.
Figure 9:
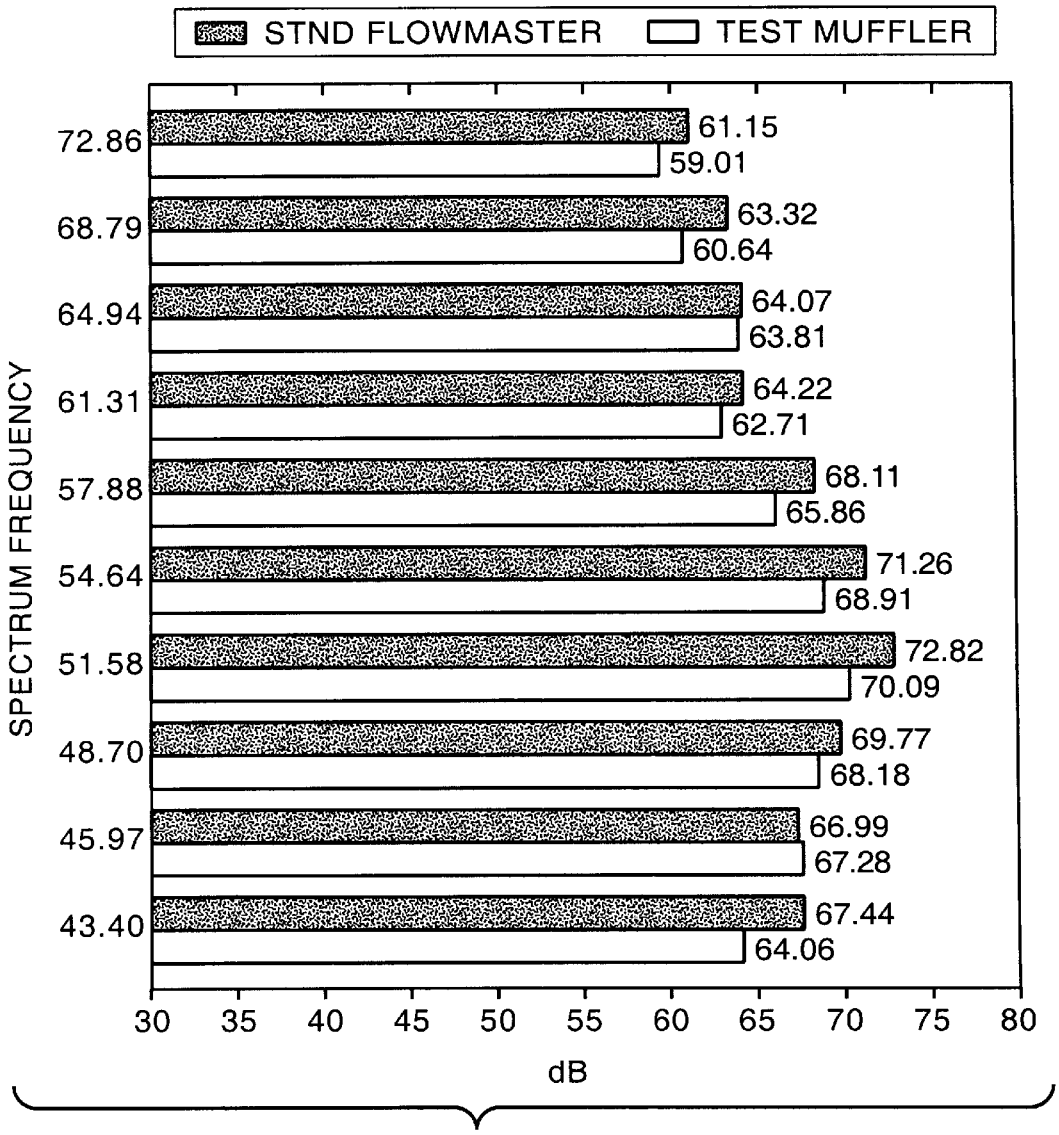
Figure 10:
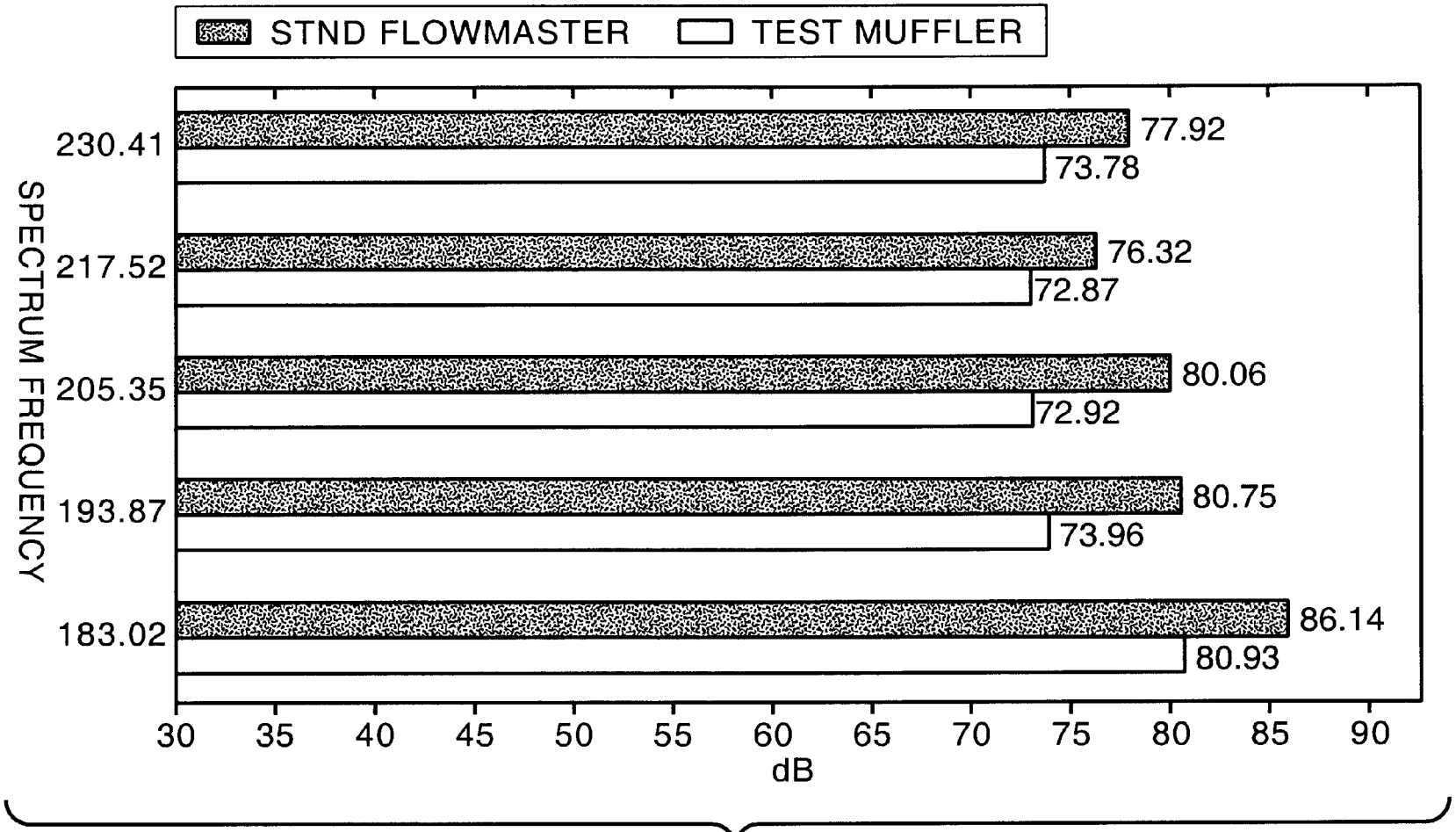

FIGS. 8–10 illustrate performance test results for the descending array muffler of FIG. 7. Each chart of these figures shows loudness, as measured in decibels, verses frequency, as measured in hertz, for a standard Flowmaster muffler and for the muffler of FIG. 7. A standard Flowmaster muffler is discussed in my prior U.S. Pat. No. 5,444,197, with reference to FIG. 1 therein. FIGS. 8 and 9 cover a sound frequency range from approximately 15.4 hz to approximately 72.86 hz. FIG. 10 covers a sound frequency range from 183.02 hz to 230.41 hz. Frequencies between 72.86 hz and 183.02 hz have either not been fully tested, or when tested, resulted in approximately equivalent decibel readings. The car engine upon which the mufflers of FIGS. 8–10 were installed was run at approximately 1500 RPM, which is a common cruising speed.

As can be seen from the figures, the muffler of FIG. 7, with a descending partition array, was noticeably quieter over the noted frequency ranges. At a frequency of 205.35 hz, the decibel difference was greater than 7 decibels. The sound levels illustrated in FIGS. 8–10 are generally the sound levels that are heard within the interior of a car. Because such sound levels are noticeably reduced by the muffler of FIG. 7, this muffler should have broad appeal in the commercial street market.

Figure 11:
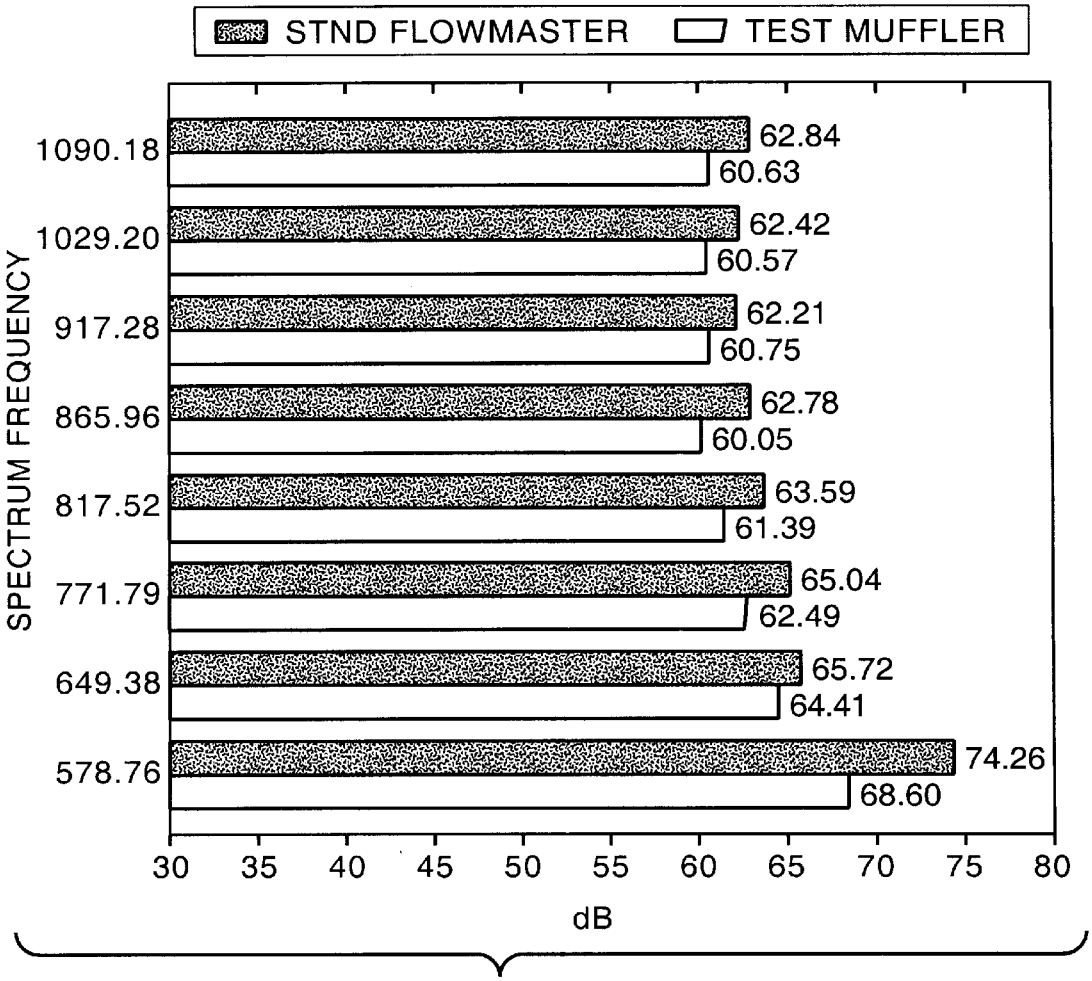

FIG. 11 shows performance test results for the muffler of FIG. 7 and a standard Flowmaster muffler when installed on an engine run at 3000 RPM. At this higher engine speed, which better approximates racing conditions as well as hard acceleration street conditions, the muffler of FIG. 7 was noticeably quieter at sound frequencies between 578.76 hz and 1090.18 hz.

Figure 12:
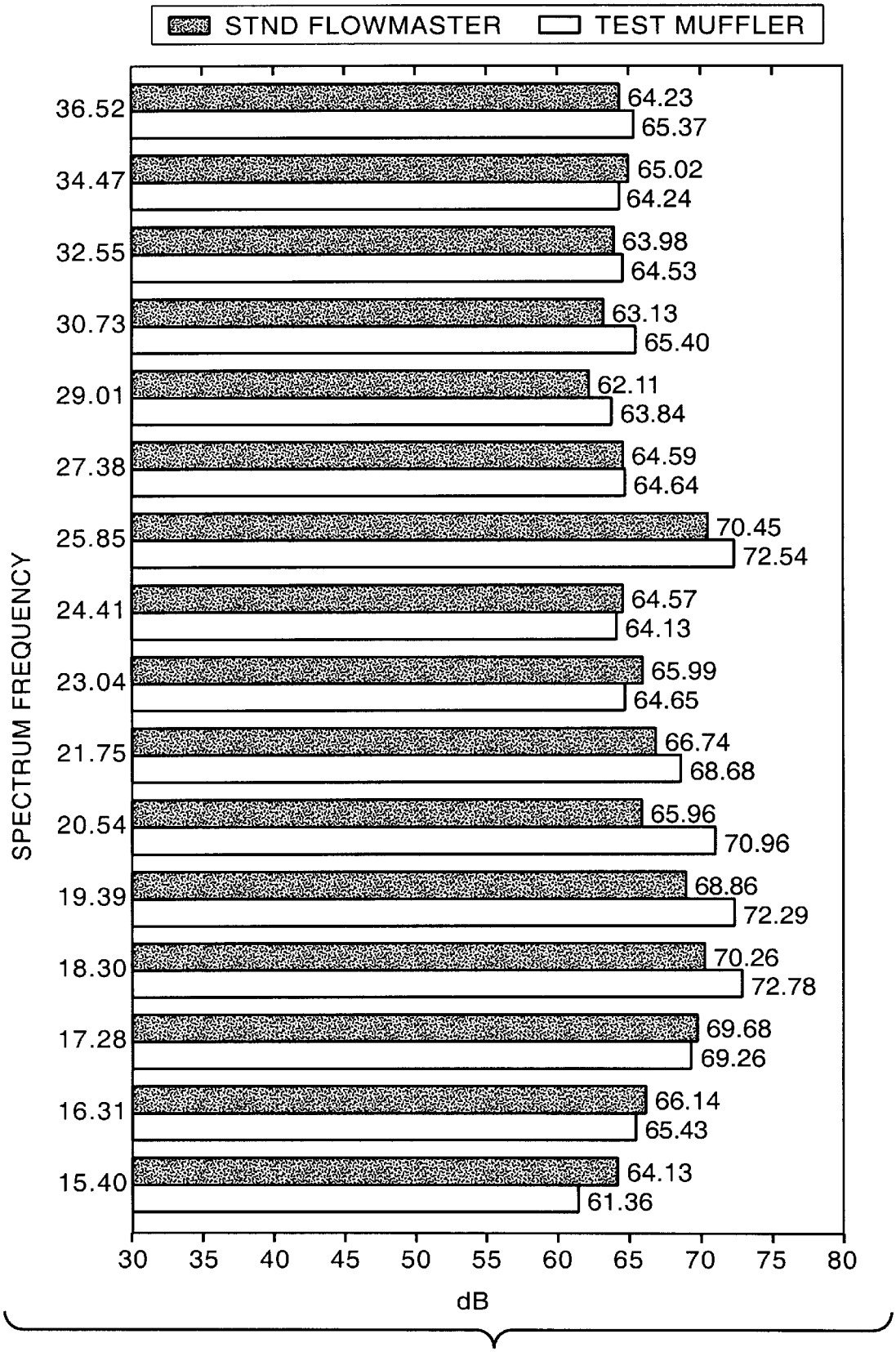
FIGS. 12–13 are each graphic representations of muffler loudness similar to FIGS. 8–11, for the muffler of FIGS. 3 and 4.
Figure 13:
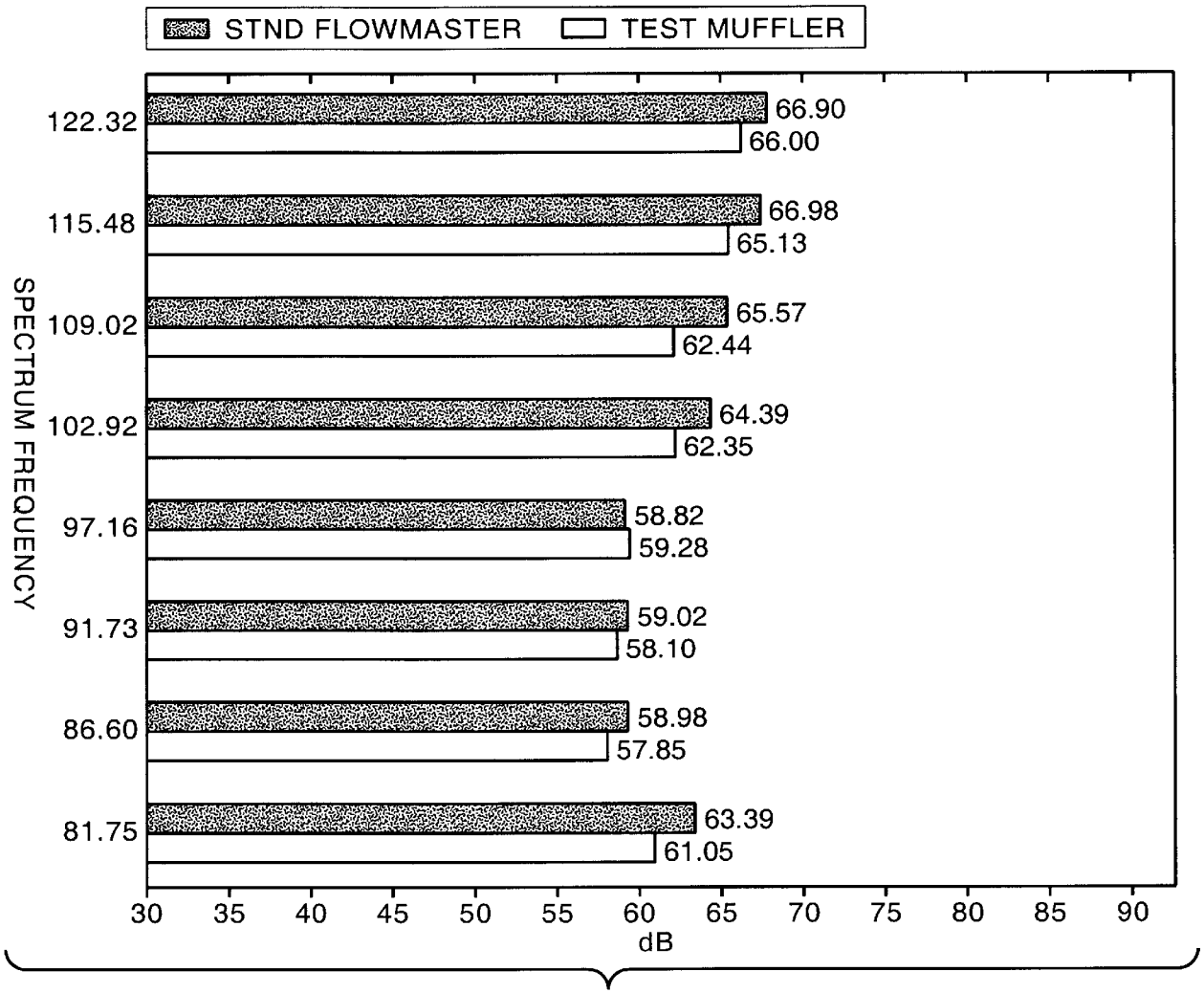

FIGS. 12 and 13 compare the ascending array muffler of FIGS. 3 and 4 with the same standard Flowmaster muffler used to produce the test results of FIGS. 8–11. As can be seen, at lower frequencies, the ascending array muffler was louder than the standard muffler, while at higher frequencies, the ascending array muffler was quieter. This type of sound spectrum performance can be desirable for those who appreciate a certain type of deep sounding exhaust noise at low RPM's.

It will be understood by persons of skill in the art that many changes, modifications, additions, and deletions can be made to the mufflers shown in the drawings and discussed in the specification without departing from the spirit and scope of the present invention. Accordingly, the present invention should not be limited to the specific embodiments disclosed in the specification, but rather should be limited only by the following claims interpreted under accepted legal principles, including the doctrine of equivalents and reversal of parts.

What is claimed is:

1. In a muffler including a casing having an inlet opening and an outlet opening, a first divider partition secured in the casing and formed and positioned to divide substantially all incoming exhaust gases for flow along a main flow path in the casing past outward ends of the first partition, and a second collector partition secured in the casing downstream of the first divider partition, the second collector partition forming in part a collector opening and the second collector partition being formed to direct the divided exhaust gases toward each other for flow of substantially all of the exhaust gases through the collector opening, the improvement in the muffler comprising:

a first intermediate partition secured in the casing between and spaced from the divider and collector partitions, the intermediate partition being formed to permit flow of the divided exhaust gases past outward ends of the intermediate partition, the outward end portions of the intermediate partition being spaced from the outward end portions of the divider partition, the spaces defined between the outward end portions of the divider partition and outward end portions of the intermediate partition being oriented with respect to the main flow path so as to create a low pressure region in these spaces as exhaust gases flow along the main flow path past the outward ends of the divider and intermediate partitions, the first divider partition and the first intermediate partition being sufficiently non-porous to maintain the low pressure region therebetween.

2. The muffler of claim 1, wherein the orientation of the spaces defined between the outward end portions of the divider and intermediate partitions and the main flow path creates a venturi effect wherein the low pressure region is formed between the divider and intermediate partitions.

3. The muffler of claim 1, wherein the spaces defined between the outward end portions of the divider and intermediate partitions are oriented at an angle with respect to the main flow path of no greater than approximately one hundred degrees.

4. The muffler of claim 1, wherein the space defined between the divider and intermediate partitions is concave in shape and faces away from the direction of the incoming exhaust gases.

5. The muffler of claim 4, wherein the divider partition is a divergently tapered partition formed to deflect gases toward sidewalls of the casing, and the intermediate partition is divergently tapered, and the partition walls of the divider and intermediate partitions are substantially parallel with each other.

6. The muffler of claim 4, wherein the intermediate partition is smaller than the divider partition so that the divider partition and the intermediate partitions are arranged in a descending manner.

7. The muffler of claim 6, wherein the outward ends of the divider and intermediate partitions confront the partition wall of the collector partition, so that the distance between the outward end of the divider partition and the collector partition is approximately equal to the distance between the outward end of the intermediate partition and the collector wall.

8. The muffler of claim 4, wherein the divider partition and the intermediate partition are proximately the same size.

9. The muffler of claim 4, wherein the intermediate partition is larger in size than the divider partition so that the divider and intermediate partitions are arranged in an ascending manner.

10. The muffler of claim 4, wherein the divider partition and the intermediate partition have generally the same shape and are in alignment with each other so that the partition walls of the divider and intermediate partitions are substantially parallel with each other at their outward end portions.

11. The muffler of claim 1, and further comprising a reflector partition having a surface cupped in a direction facing away from the collector opening, the reflector partition being positioned between the intermediate partition and the collector partition.

12. The muffler of claim 11, wherein the reflector partition is formed and positioned to permit the exhaust gases to flow past the outward ends of the reflector partition.

13. The muffler of claim 11, and further comprising a second intermediate partition positioned between the first intermediate partition and the reflector partition, the second intermediate partition being formed to permit flow of exhaust gases past outward ends of the second intermediate partition.

14. The muffler of claim 13, wherein the outward end portions of the second intermediate partition and the outward end portions of the first intermediate partition define therebetween spaces that are oriented with respect to the main flow path so as to create a low pressure region in these spaces as exhaust gases flow along the main flow path past the outward ends of the first and second intermediate partitions and wherein the second intermediate partition is sufficiently non-porous to maintain the low pressure region between the first and second intermediate partitions.

15. The muffler of claim 14, wherein the space defined between the divider partition and the first intermediate partition and between the first intermediate partition and the second intermediate partition are concave in shape and face away from the direction of the incoming exhaust gases.

16. The muffler of claim 1, and further comprising a second intermediate partition positioned between the first intermediate partition and the collector partition, the second intermediate partition being formed to permit flow of exhaust gases past outward ends of the second intermediate partition.

17. The muffler of claim 16, wherein the outward end portions of the second intermediate partition and the outward end portions of the first intermediate partition define therebetween spaces that are oriented with respect to the main flow path so as to create a low pressure region in these spaces as exhaust gases flow along the main flow path past the outward ends of the first and second intermediate partitions and wherein the second intermediate partition is sufficiently non-porous to maintain the low pressure region between the first and second intermediate partitions.

18. The muffler of claim 17, wherein the spaces defined between the divider partition and the first intermediate partition and between the first intermediate partition and the second intermediate partition are concave in shape and face away from the direction of the incoming exhaust gases.

19. The muffler of claim 1, wherein the casing includes an expansion chamber in the main flow path between the inlet opening and the divider petition.

20. A muffler, comprising:

a casing having an exhaust gas inlet opening and an exhaust gas outlet opening, a partition array including a divider partition that is mounted within the casing and positioned to receive incoming exhaust gases and direct the incoming exhaust gases at least partially laterally around outward ends of the divider partition, a first intermediate partition spaced downstream from the divider partition and in a position permitting exhaust gases to flow past outward ends of the first intermediate partition, a second intermediate partition spaced downstream from the first intermediate partition and in a position permitting exhaust gases to flow past the outward ends of the second intermediate partition, and a collector partition mounted within the casing downstream of the partition array to direct exhaust gases to the outlet opening, the spaces between the divider partition, the first intermediate partition, and the second intermediate partition being concave in shape and facing away from the inlet opening, the outward portions of the spaces defined between the divider partition and the first and second intermediate partitions are oriented at an angle with respect to the direction of exhaust gas flow past the outward ends of the partitions so as to create a low pressure region in these outward spaces as exhaust gases flow past the outward ends of the partitions, and wherein the second intermediate partition is sufficiently non-porous to maintain the low pressure region between the first and second intermediate partitions, whereby sound is attenuated in the spaces between the divider partition and the first and second intermediate partitions as exhaust gases are directed past the outward ends of the partitions.

21. The muffler of claim 20, wherein the outward portions of the spaces defined between the divider partition and the first and second intermediate partitions are oriented at an angle with respect to the direction of exhaust gas flow past the outward ends of the partitions, which angle is sufficient to allow sound vibrations to enter the spaces between the partitions, yet is not so great as to divert a substantial amount of the exhaust gases.

22. The muffler of claim 20, wherein the space defined between the divider partition and the first intermediate partition has a length greater than the length of the space defined between the first and second intermediate partitions.

23. The muffler of claim 20, wherein the space defined between the divider partition and the first intermediate partition has a length shorter than the length of the space defined between the first and second intermediate partitions.

24. The muffler of claim 20, wherein the space defined between the divider partition and the first intermediate partition has a length approximately equal to the length of the space defined between the first and second intermediate partitions.

25. The muffler of claim 20, wherein the angle defined between the outward portions of the spaces between the partitions and the exhaust flow is no greater than approximately one hundred degrees.

26. The muffler of claim 20, wherein the divider partition is a divergently tapered partition formed to deflect gases toward sidewalls of the casing, and the first and second intermediate partitions are divergently tapered, and the partition walls of the divider and intermediate partitions are substantially parallel with each other.

27. The muffler of claim 20, and further comprising a reflector partition formed in the casing and positioned between the second intermediate partition and the collector partition, the reflector partition being cupped in a direction facing away from the collector opening.

28. The muffler of claim 27, wherein the reflector partition is positioned to permit flow of exhaust gases past outward ends of the reflector partition.

29. The muffler of claim 20, and further comprising an expansion chamber formed in the casing between the exhaust gas inlet opening and the divider partition.

30. A method of attenuating sound in a muffler including a casing having an exhaust gas inlet opening and an exhaust gas outlet opening, a partition array including a divider partition that is mounted within the casing and positioned to receive incoming exhaust gases and direct the incoming exhaust gases at least partially laterally around outward ends of the divider partition, a first intermediate partition spaced downstream from the divider partition and in a position permitting exhaust gases to flow past outward ends of the first intermediate partition, a second intermediate partition spaced downstream from the first intermediate partition and in a position permitting exhaust gases to flow past the outward ends of the second intermediate partition, and a collector partition mounted within the casing downstream of the partition array to direct exhaust gases to the outlet opening, the spaces between the divider partition, the first intermediate partition, and the second intermediate partition being concave in shape and facing away from the inlet opening, comprising the steps of:

introducing exhaust gases through the inlet opening, passing the exhaust gases around the divider partition to direct the incoming exhaust gases at least partially laterally around outward ends of the divider partition, passing the exhaust gases past the outward ends of the first and second intermediate partitions in a manner whereby sound is attenuated in the spaces between the divider partition and the first and second intermediate partitions as exhaust gases are directed past the outward ends of the partitions, the divider partition, first intermediate partition and the second intermediate partition being sufficiently non-porous to create low pressure regions between the partitions, and passing the exhaust gases through an opening in the collector partition and out through the outlet opening.

31. The method of claim 30, wherein the outward portions of the spaces defined between the divider partition and the first and second intermediate partitions are oriented at an angle with respect to the direction of exhaust gas flow past the outward ends of the partitions, which angle is sufficient to allow sound vibrations to enter the spaces between the partitions, yet is not so great as to divert a substantial amount of the exhaust gases from the main flow path, so as exhaust gases move past the outward ends of the partitions, sound vibrations enter the spaces between the partitions and attenuate therein.

32. The method of claim 30, wherein the space defined between the divider partition and the first intermediate partition has a length greater than the length of the space defined between the first and second intermediate partitions, so that each space attenuates different frequency sound vibrations.

33. The method of claim 30, wherein the space defined between the divider partition and the first intermediate partition has a length shorter than the length of the space defined between the first and second intermediate partitions, so that low frequency sound vibrations are not completely eliminated.

34. The method of claim 30, wherein the space defined between the divider partition and the first intermediate partition has a length approximately equal to the length of the space defined between the first and second intermediate partitions.

35. The method of claim 30, wherein the outward portions of the spaces defined between the divider partition and the first and second intermediate partitions are oriented at an angle with respect to the direction of exhaust gas flow past the outward ends of the partitions, which angle is no greater that approximately one hundred degrees, so that as exhaust gases move past the outward ends of the partitions, a low pressure region is created in these outward spaces.

36. The method of claim 30, wherein the casing further includes a reflector partition positioned between the second intermediate partition and the collector partition, the reflector partition being cupped in a direction facing away from the collector opening, so that as exhaust gases move through the casing, sound vibrations are reflected off of the reflector partition in a direction away from the outlet opening.

37. The method of claim 30, wherein the casing further includes an expansion chamber formed in the casing between the exhaust gas inlet opening and the divider partition, so that exhaust gases introduced through the inlet opening form a flow path from the inlet opening to the divider partition.

38. In a muffler including a casing having an inlet opening and an outlet opening, a first divider partition secured in the casing and formed and positioned to divide substantially all incoming exhaust gases for flow along a main flow path in the casing past outward ends of the first partition, and a second collector partition secured in the casing downstream of the first divider partition, the second collector partition forming in part a collector opening and the second collector partition being formed to direct the divided exhaust gases toward each other for flow of substantially all of the exhaust gases through the collector opening, the improvement in the muffler comprising:

a first imperforate intermediate partition secured in the casing between and spaced from the divider and collector partitions, the intermediate partition being formed to permit flow of the divided exhaust gases past outward ends of the intermediate partition, the outward end portions of the intermediate partition being spaced from the outward end portions of the divider partition, and, the divider partition being imperforate to prevent exhaust gas flow through the divider partition, the spaces defined between the outward end portions of the divider partition and outward end portions of the intermediate partition being oriented with respect to the main flow path so as to create a low pressure region in these spaces as exhaust gases flow along the main flow path past the outward ends of the divider and intermediate partitions, the imperforate design of first divider partition and the first intermediate partition creating a low pressure region therebetween.

39. The muffler of claim 38, wherein the orientation of the spaces defined between the outward end portions of the divider and intermediate partitions and the main flow path creates a venturi effect wherein the low pressure region is formed between the divider and intermediate partitions.

40. The muffler of claim 38, wherein the spaces defined between the outward end portions of the divider and intermediate partitions are oriented at an angle with respect to the main flow path of no greater than one hundred degrees.

41. The muffler of claim 38, wherein the space defined between the divider and intermediate partitions is concave in shape and faces away from the direction of incoming exhaust gases.

42. The muffler of claim 41, wherein the divider partition is a divergently tapered partition formed to deflect gases toward sidewalls of the casing, and the intermediate partition is divergently tapered, and the partition walls of the divider and intermediate partitions are substantially parallel with each other.

43. The muffler of claim 41, wherein the intermediate partition is smaller than the divider partition so that the divider partition and the intermediate partitions are arranged in a descending manner, and the outward ends of the divider and intermediate partitions confront the partition wall of the collector partition, so that the distance between the outward end of the divider partition and the collector partition is equal to the distance between the outward end of the intermediate partition and the collector wall.

44. The muffler of claim 41, wherein the divider partition and the intermediate partition have generally the same shape and are in alignment with each other so that the partition walls of the divider and intermediate partitions are substantially parallel with each other at their outward end portions.

45. The muffler of claim 38, and further comprising a reflector partition having a surface cupped in a direction facing away from the collector opening, the reflector partition being positioned between the intermediate partition and the collector partition.

46. The muffler of claim 45, and further comprising a second intermediate partition positioned between the first intermediate partition and the reflector partition, the second intermediate partition being formed to permit flow of exhaust gases pas outward ends of the second intermediate partition.

47. The muffler of claim 46, wherein the outward end portions of the second intermediate partition and the outward end portions of the first intermediate partition define therebetween spaces that are oriented with respect to the main flow path so as to create a low pressure region in these spaces as exhaust gases flow along the main flow path past the outward ends of the first and second intermediate partitions, the second intermediate partition creating a low pressure region between the first and second intermediate partitions.

48. The muffler of claim 38, and further comprising a second intermediate partition positioned between the first intermediate partition and the collector partition, the second intermediate partition being formed to permit flow of exhaust gases past outward ends of the second intermediate partition.

49. The muffler of claim 48, wherein the outward end portions of the second intermediate partition and the outward end portions of the first intermediate partition define therebetween spaces that are oriented with respect to the main flow path so as to create a low pressure region in these spaces as exhaust gases flow along the main flow path past the outward ends of the first and second intermediate partitions, the second intermediate partition creating a low pressure region between the first and second intermediate partitions.

50. The muffler of claim 49, wherein the spaces defined between the divider partition and the first intermediate partition and between the first intermediate partition and the second intermediate partition are concave in shape and face away from the direction of the incoming exhaust gases.

51. A muffler, comprising:

a casing having an exhaust gas inlet opening and an exhaust gas outlet opening, a partition array including an imperforate divider partition that is mounted within the casing and positioned to receive incoming exhaust gases and direct the incoming exhaust gases at least partially laterally around outward ends of the divider partition, an imperforate first intermediate partition spaced downstream from the divider partition and in a position permitting exhaust gases to flow past outward ends of the first intermediate partition, a second imperforate intermediate partition spaced downstream from the first intermediate partition and in a position permitting exhaust gases to flow past the outward ends of the second intermediate partition, and a collector partition mounted within the casing downstream of the partition array to direct exhaust gases to the outlet opening, the spaces between the divider partition, the first intermediate partition, and the second intermediate partition being concave in shape and facing away from the inlet opening, the outward portions of the spaces defined between the divider partition and the first and second intermediate partitions are oriented at an angle with respect to the direction of exhaust gas flow past the outward ends of the partitions so as to create a low pressure region in these outward spaces as exhaust gases flow past the outward ends of the partitions, the second intermediate partition creating a low pressure region between the first and second intermediate partitions, whereby sound is attenuated in the spaces between the divider partition and the first and second intermediate partitions as exhaust gases are directed past the outward ends of the partitions.

52. The muffler of claim 51, wherein the outward portions of the spaces defined between the divider partition and the first and second intermediate partitions are oriented at an angle with respect to the direction of exhaust gas flow past the outward ends of the partitions, which angle is sufficient to allow sound vibrations to enter the spaces between the partitions, yet is not so great as to divert a substantial amount of the exhaust gases.

53. The muffler of claim 51, wherein the space defined between the divider partition and the first intermediate partition has a length greater than the length of the space defined between the first and second intermediate partitions.

54. The muffler of claim 51, wherein the outward portions of the spaces defined between the divider partition and the first and second intermediate partitions are oriented at an angle with respect to the direction of exhaust gas flow past the outward ends of the partitions so as to create a low pressure region in these outward spaces as exhaust gases flow past the outward ends of the partitions.

55. The muffler of claim 51, wherein the divider partition is a divergently tapered partition formed to deflect gases toward sidewalls of the casing, and the first and second intermediate partitions are divergently tapered, and the partition walls of the divider and intermediate partitions are substantially parallel with each other.

56. A method of attenuating sound in a muffler including a casing having an exhaust gas inlet opening and an exhaust gas outlet opening, a partition array including a divider partition that is mounted within the casing and positioned to receive incoming exhaust gases and direct the incoming exhaust gases at least partially laterally around outward ends of the divider partition, a first intermediate partition spaced downstream from the divider partition and in a position permitting exhaust gases to flow past outward ends of the first intermediate partition, a second intermediate partition spaced downstream from the first intermediate partition and in a position permitting exhaust gases to flow past the outward ends of the second intermediate partition, and a collector partition mounted within the casing downstream of the partition array to direct exhaust gases to the outlet opening, the spaces between the divider partition, the first intermediate partition, and the second intermediate partition being concave in shape and facing away from the inlet opening, comprising the steps of:

introducing exhaust gases through the inlet opening, passing the exhaust gases around the divider partition to direct the incoming exhaust gases at least partially laterally around outward ends of the divider partition, the divider partition being imperforate to exhaust gas flow therethrough, passing the exhaust gases past the outward ends of the first and second intermediate partitions in a manner whereby sound is attenuated in the spaces between the divider partition and the first and second intermediate partitions as exhaust gases are directed past the outward ends of the partitions, the divider partition, first intermediate partition and the second intermediate partition creating low pressure regions between the partitions, and passing the exhaust gases through an opening in the collector partition and out through the outlet opening.

57. The method of claim 56, wherein the outward portions of the spaces defined between the divider partition and the first and second intermediate partitions are oriented at an angle with respect to the direction of exhaust gas flow past the outward ends of the partitions, which angle is sufficient to allow sound vibrations to enter the spaces between the partitions, yet is not so great as to divert a substantial amount of the exhaust gases from the main flow path, so as exhaust gases move past the outward ends of the partitions, sound vibrations enter the spaces between the partitions and attenuate therein.

58. The method of claim 56, wherein the space defined between the divider partition and the first intermediate partition has a length greater than the length of the space defined between the first and second intermediate partitions, so that each space attenuates different frequency sound vibrations.

59. The method of claim 56, wherein the outward portions of the spaces defined between the divider partition and the first and second intermediate partitions are oriented at an angle with respect to the direction of exhaust gas flow past the outward ends of the partitions, which angle is no greater than one hundred degrees, so that as exhaust gases move past the outward ends of the partitions, a low pressure region is created in these outward spaces.

* * * * *